US006681507B1

(12) United States Patent
Lieziert

(10) Patent No.: US 6,681,507 B1
(45) Date of Patent: Jan. 27, 2004

(54) LICENSE PLATE MOUNTING BRACKET FOR A VEHICLE WITH A WINCH

(75) Inventor: Christopher W. Lieziert, 57899 Fisher La., St. Helens, OR (US) 97051

(73) Assignee: Christopher W. Lieziert, Saint Helens, OR (US)

( * ) Notice: Subject to any disclaimer, the term of this patent is extended or adjusted under 35 U.S.C. 154(b) by 0 days.

(21) Appl. No.: 10/457,533

(22) Filed: Jun. 10, 2003

(51) Int. Cl.[7] ..... G09F 7/00
(52) U.S. Cl. ..... 40/209; 40/200; 40/204
(58) Field of Search ..... 40/209, 200, 204

(56) References Cited

U.S. PATENT DOCUMENTS 1,403,073 A * 1/1922 Eklof ..... 40/209
2,579,230 A * 12/1951 Giboney ..... 40/209
2,618,089 A * 11/1952 Rose ..... 40/209
4,736,539 A * 4/1988 Dickinson ..... 40/209
5,027,537 A 7/1991 Freeman et al.
5,301,091 A * 4/1994 Chen ..... 40/204
5,638,623 A 6/1997 Shuen
5,813,640 A 9/1998 Koch et al.
5,870,841 A 2/1999 Brody, II et al.
6,167,645 B1 1/2001 Gasko et al.

* cited by examiner

*Primary Examiner*—Gary Hoge

(57) ABSTRACT

A license plate mounting bracket for mounting a license plate or other decorative plate to the vertical guide rollers on a winch includes a frame, a back plate, eight nut and bolt assemblies, and two clips. The frame is shaped and dimensioned for receiving a standard license plate. The back plate, which is flat and the size of a standard license plate, is bolted into the frame. The four nut and bolt assemblies bolt the frame, a license plate and the back plate together with the back plate positioned behind the license plate. The two clips extend from the backside of the back plate and are shaped and dimensioned to clip to the vertical guide rollers of a winch.

8 Claims, 12 Drawing Sheets

LICENSE PLATE MOUNTING BRACKET FOR A VEHICLE WITH A WINCH

BACKGROUND OF THE INVENTION

1. Field of the Invention

The present invention relates to brackets for mounting license plates to vehicles and, more particularly, to a bracket adapted for clipping a license plate onto a winch that is mounted on the front or rear of an automobile.

2. Description of the Related Art

A winch is an apparatus consisting of a hook attached to one end of a cable that is wound around a motor-powered cylinder. Typically, it is used to free an off-road vehicle that is stuck in mud. In such a circumstance, the cable is unwound from the cylinder and wrapped around a tree. The winch motor then rewinds the cable around the cylinder thereby pulling the vehicle from the mud and toward the tree.

When a winch is mounted on either the front or rear end of a vehicle, such as a sport utility vehicle or a pick-up truck, the winch often obstructs the area of the vehicle adapted for receiving a license plate bracket. Usually, a license plate bracket is used to secure a license plate to a vehicle by first securing the license plate to the bracket and then securing the bracket to a surface on the vehicle adapted for receiving the bracket. However, for a license plate to be completely visible when a winch is present, the license plate typically must be mounted in a make-shift manner. In such circumstances, the license plate is often simply tied to the winch with either wire or twine.

Although license plate mounting devices are known in the prior art, a device for mounting a license plate to a winch is not known and, likewise, a device allowing a license plate to be easily secured to and removed from a vehicle without the aid of one or more tools in not known.

Two examples of prior art license plate brackets are provided by U.S. Pat. No. 5,813,640 to Koch et al., and U.S. Pat. No. 6,167,645 to Gasko et al. The Koch patent discloses a license plate bracket with a horizontal base that is mounted to the underside of a bumper. The horizontal base is mounted to the bumper via one or more fasteners each of which consists of a bushing and a grommet. However, although the Koch bracket can be both mounted to and removed from a bumper without the use of tools, mounting and removing the bracket does require either assembling or disassembling the fasteners which may require extending one's hand into an awkward position in order to reach behind the bumper and, significantly, the bracket is not suited for mounting a license plate to a winch.

The Gasko patent discloses a license plate bracket adapted for mounting to the grille of an automobile. The bracket is secured to an automobile grille via two fasteners and two hooks that extend rearward from the bracket. However, although the bracket allows a license plate to be secured on a portion of an automobile not normally suited for receiving a license plate, the use of a tool is necessary for mounting the bracket and, similar to the Koch bracket, the Gasko bracket is not suited for mounting a license plate to a winch.

Consequently, neither of the above patents, taken either singly or in combination, is seen to describe the instant invention as claimed and, therefore, a device for mounting a license plate to a vehicle solving the aforementioned problems is desired.

SUMMARY OF THE INVENTION

The present invention facilitates the mounting of a license plate or other decorative plate to the vertical roller guides on a winch. The device includes a frame, a back plate, eight nut and bolt assemblies, and two clips. The frame is shaped and dimensioned for receiving a standard license plate. The back plate, which is flat and the size of a license plate, is bolted into the frame. Four of the nut and bolt assemblies bolt the frame, a license plate and the back plate together with the back plate positioned behind the license plate. The remaining nut and bolt assemblies bolt the two clips to the back plate. The two clips extend from the backside of the back plate and are shaped and dimensioned to clip to the vertical guide rollers of a winch.

Accordingly, it is a principal object of the invention to provide a device for mounting a license plate or other decorative plate to a winch that is attached to either the front or rear end of a vehicle.

It is another object of the invention to provide a device that allows a license plate to be properly displayed on a vehicle even though the area of the vehicle adapted for receiving a license plate is obstructed by a winch.

It is a further object of the invention to provide a device that allows a license plate to be easily attached to and removed from a winch, without the aid of tools, thereby providing easy access to the winch and protecting the license plate from damage resulting from contact with off-road obstacles.

Still another object of the invention is to provide a covert for the hook and cable of a winch thereby protecting them from dirt and other debris.

Yet another object of the invention is to provide a clean appearance to a vehicle with a winch by hiding the hook and cable of the winch.

Furthermore, it is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a license plate mounting bracket that enables a standard license plate or other decorative plate to be mounted to the vertical roller guides of a winch.

Figure 6:
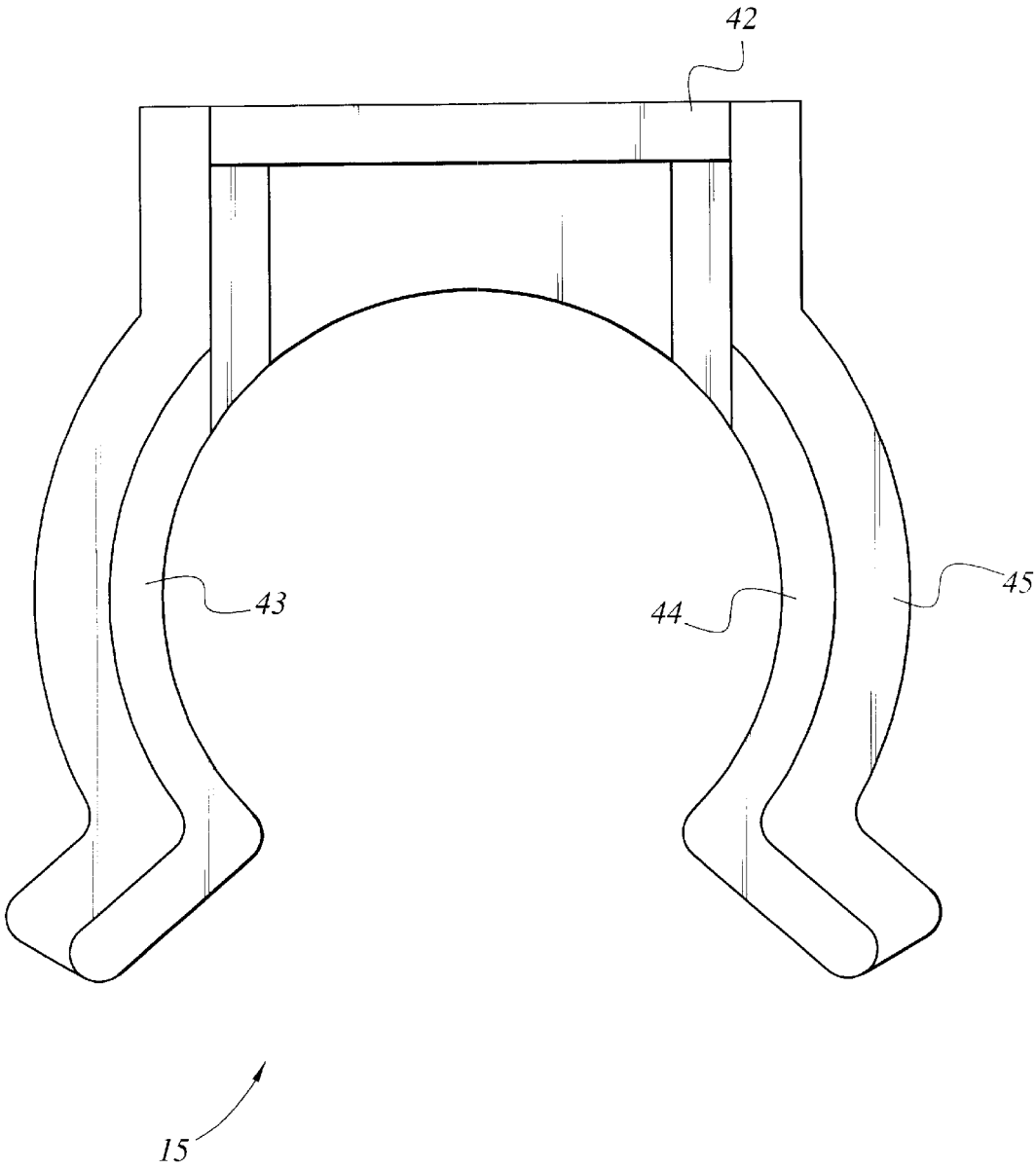
FIG. 6 is a top view of one clip for a license plate mounting bracket according to the present invention.
Figure 7:
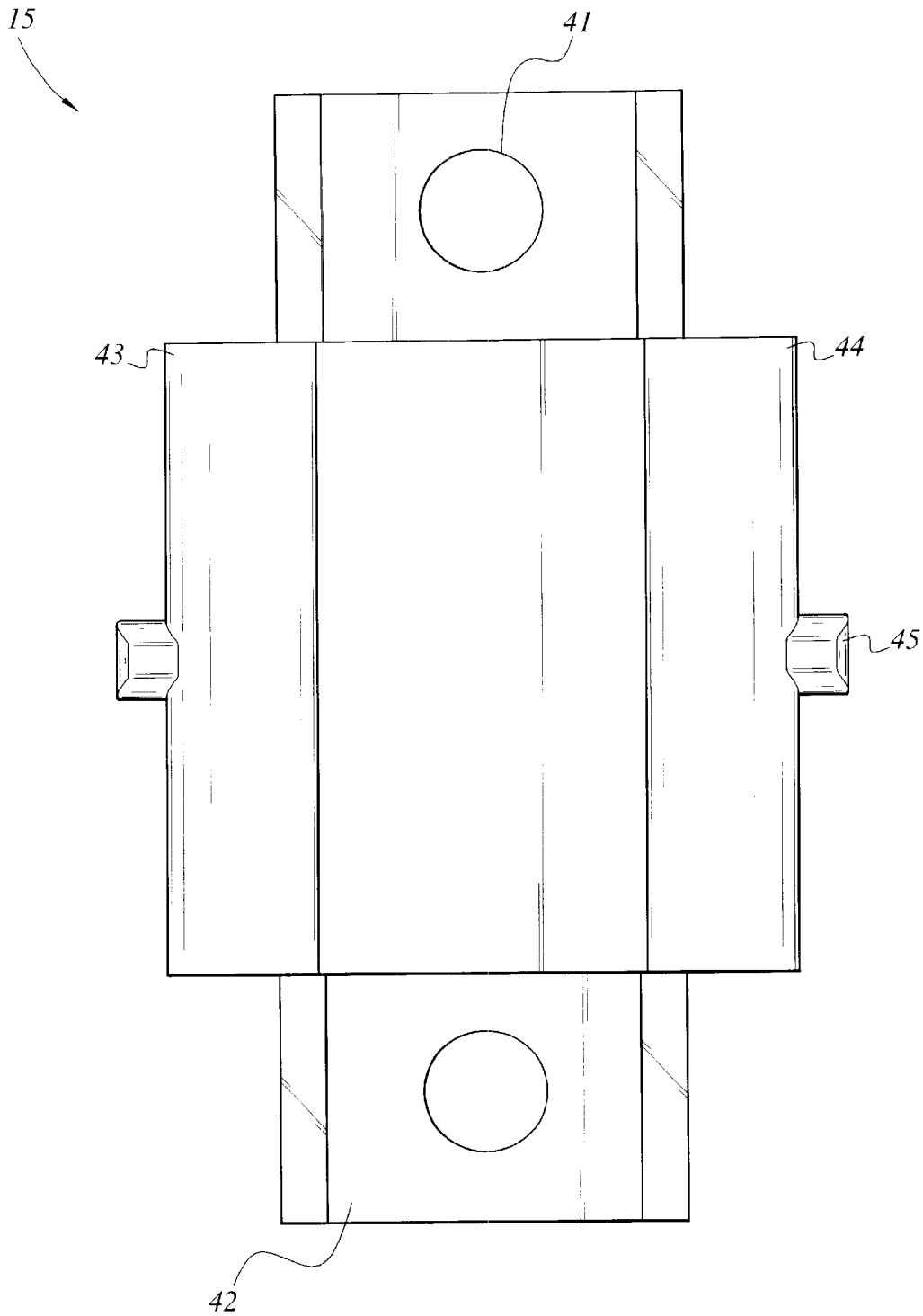
FIG. 7 is a front view of one clip for a license plate mounting bracket according to the present invention.
Figure 8:
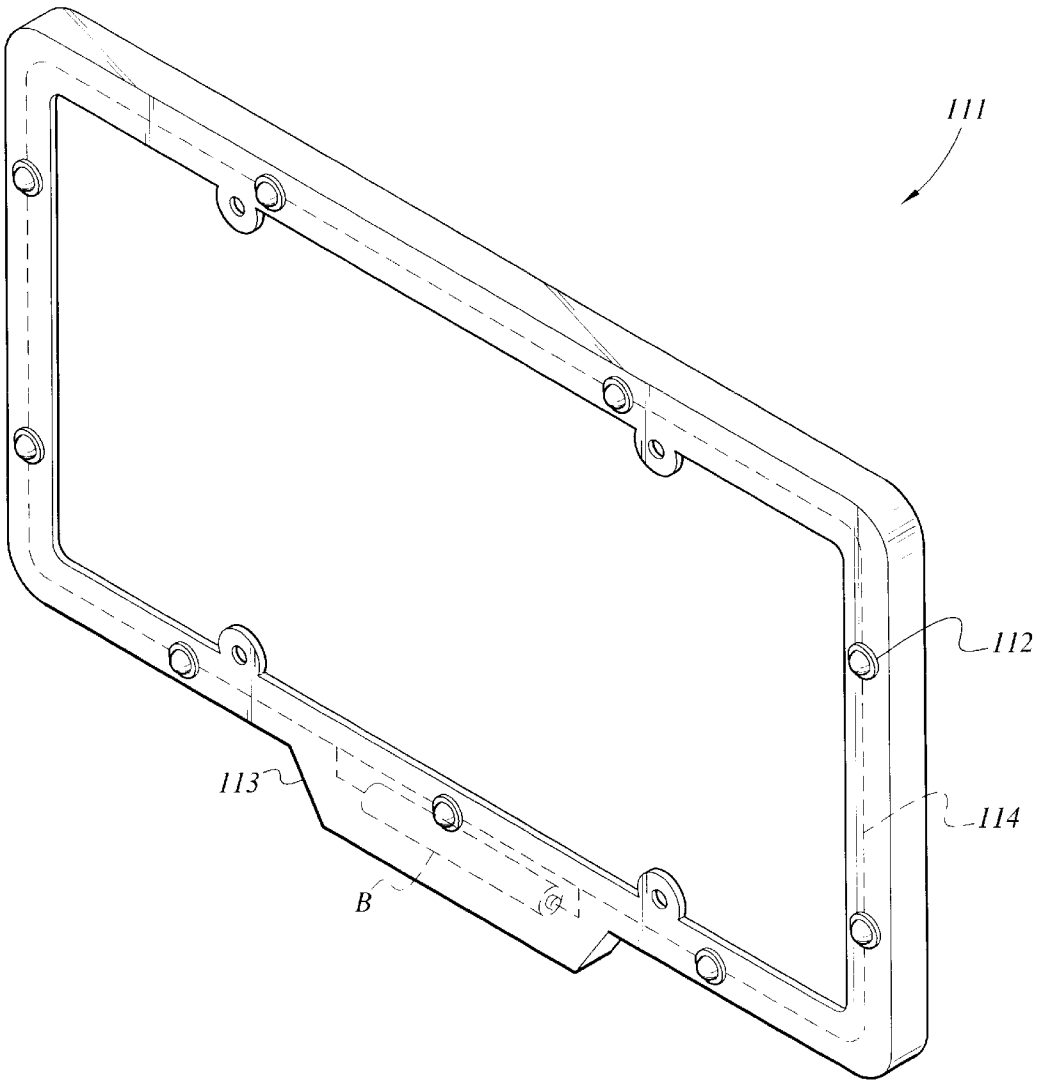
FIG. 8 is a perspective view showing the frame for an alternative embodiment license plate mounting bracket according to the present invention in which lights and a battery compartment are attached to the frame.
Figure 9:
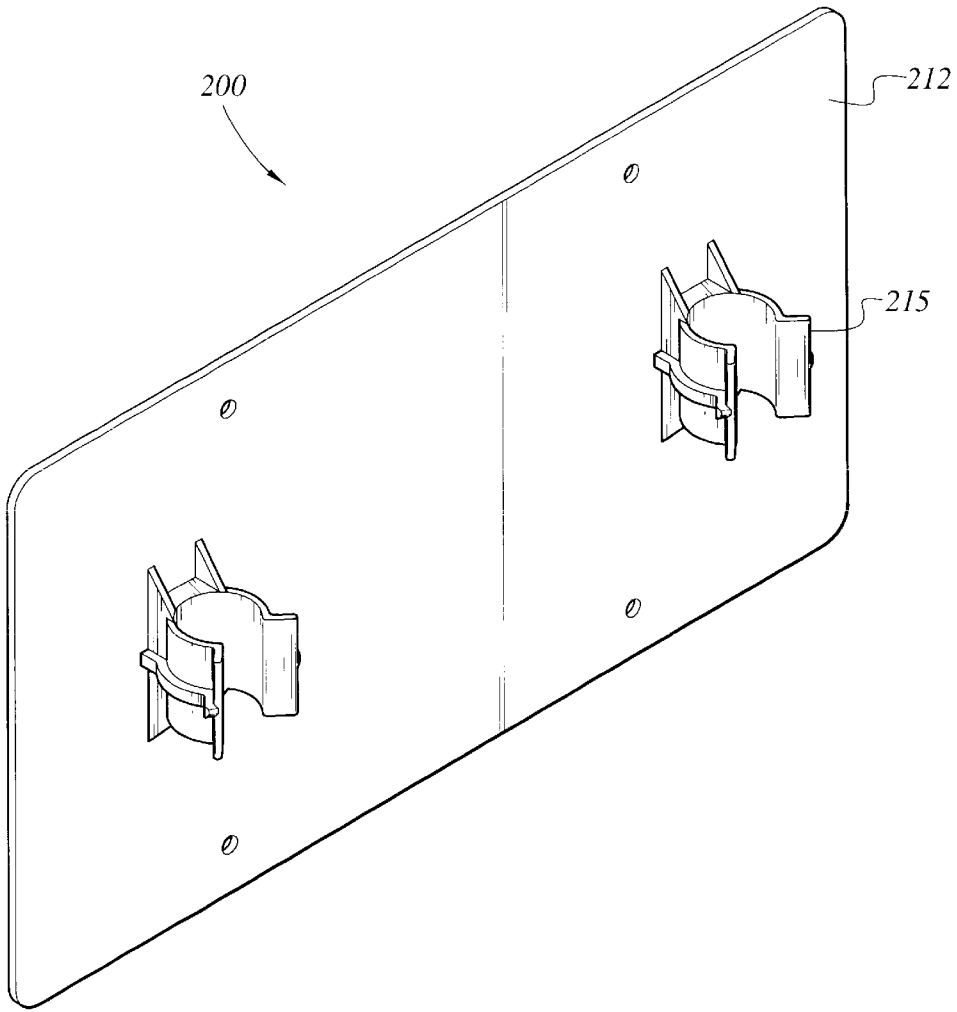
FIG. 9 is an exploded view of an alternative embodiment of a license plate mounting bracket according to the present invention in which the back plate and clips are formed from a single piece of material.
Figure 10:
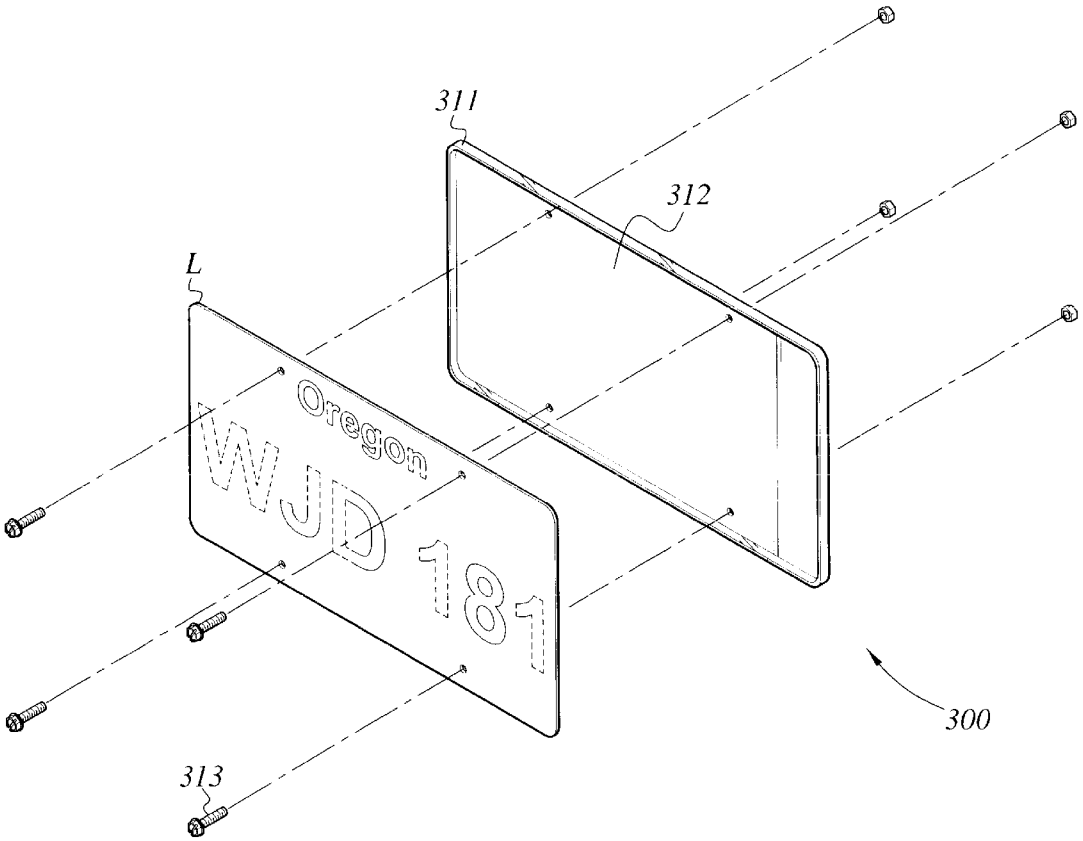
FIG. 10 is an exploded view of an alternative embodiment of a license plate mounting bracket according to the present invention in which the frame, back plate and clips are formed from a single piece of material.
Figure 11:
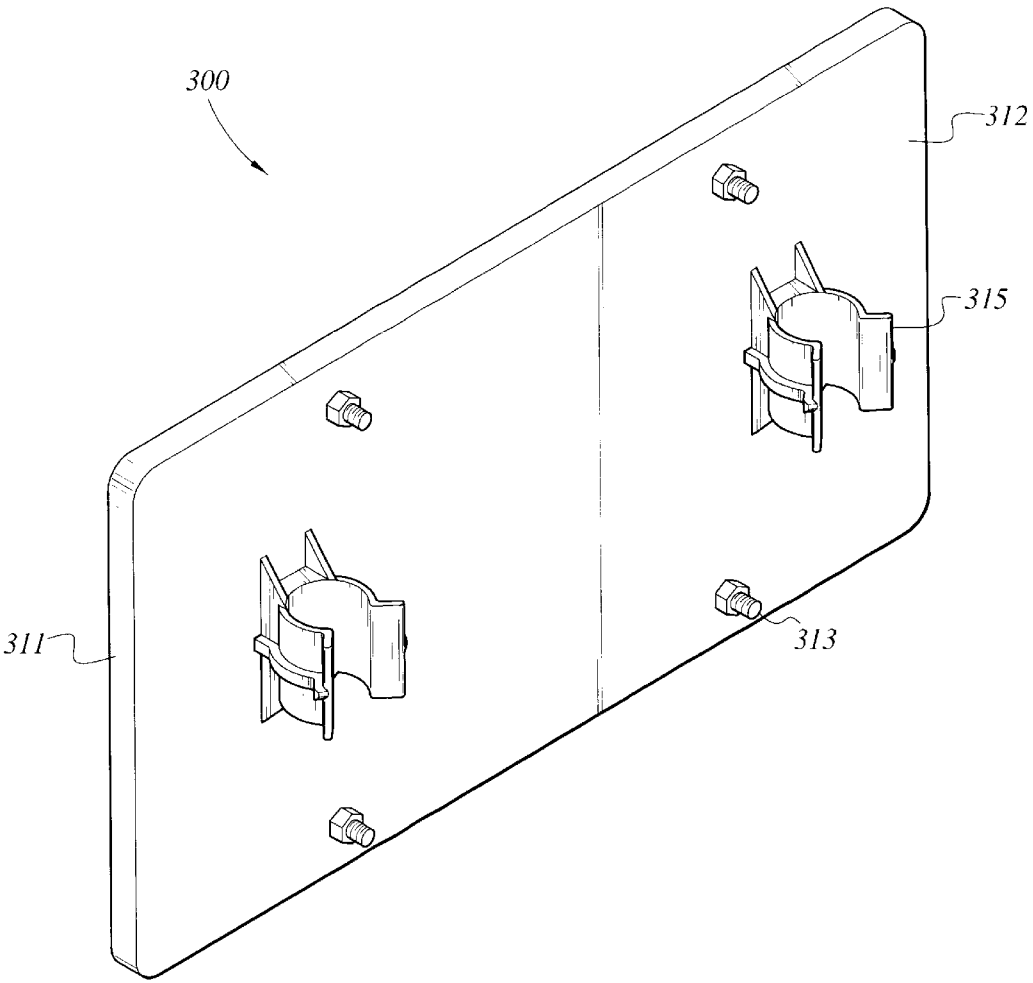
FIG. 11 is a rear, perspective view of a back plate for an alternative embodiment of a license plate mounting bracket according to the present invention in which the frame, back plate and clips are formed from a single piece of material.

Referring to the drawings, FIGS. 1–7 illustrate a first embodiment of the device, FIG. 8 illustrates the frame of a slightly modified alternative embodiment which incorporates lights on the frame, FIG. 9 illustrates an alternative embodiments wherein the back plate and clips are formed into a single component, and FIGS. 10 and 11 illustrate an alternative embodiment wherein the frame, back plate and, clips are formed into a single component.

Figure 1:
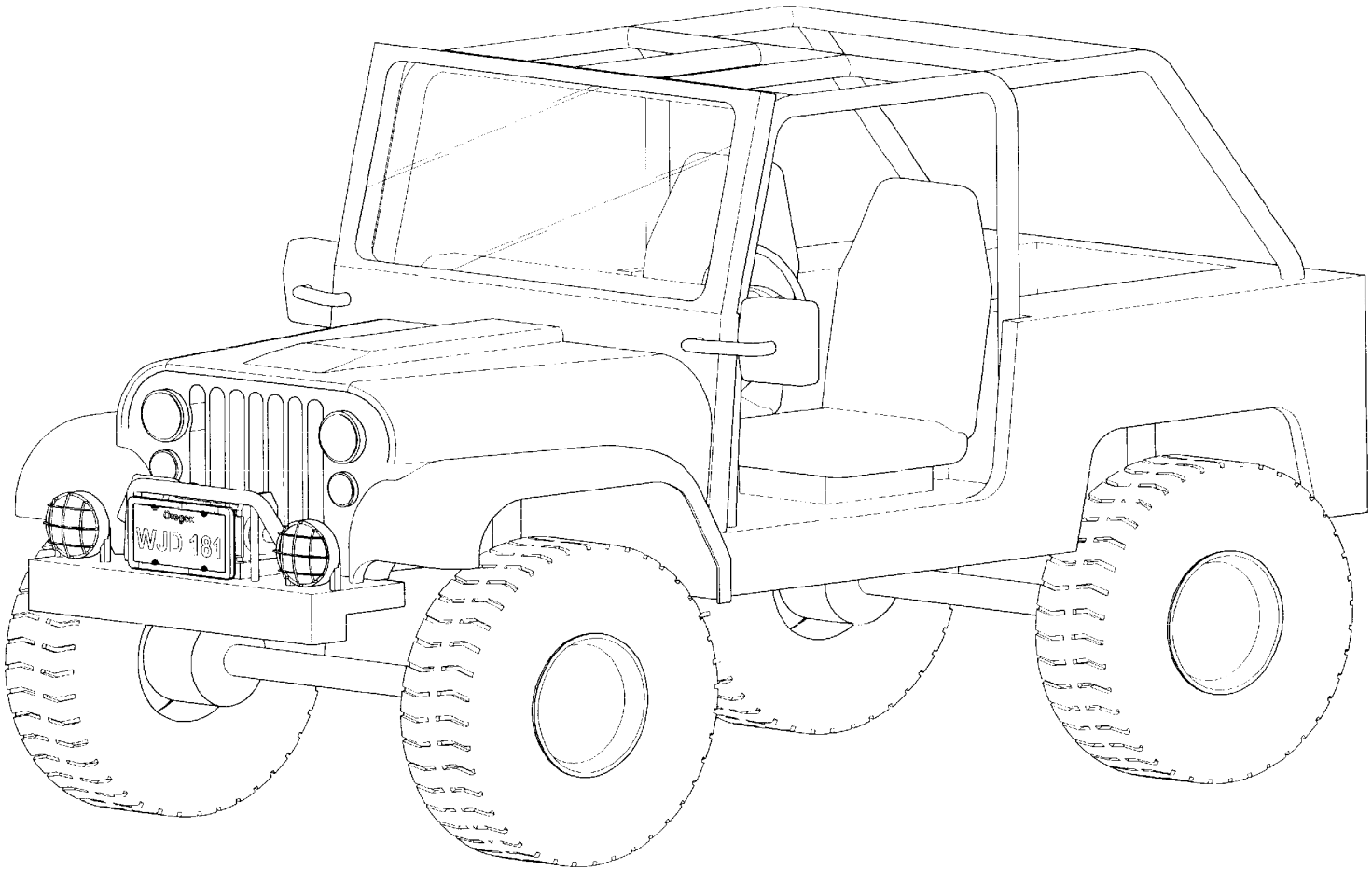
FIG. 1 is an environmental, perspective view of a license plate mounting bracket according to the present invention shown securing a license plate to a sport utility vehicle.
Figure 2:
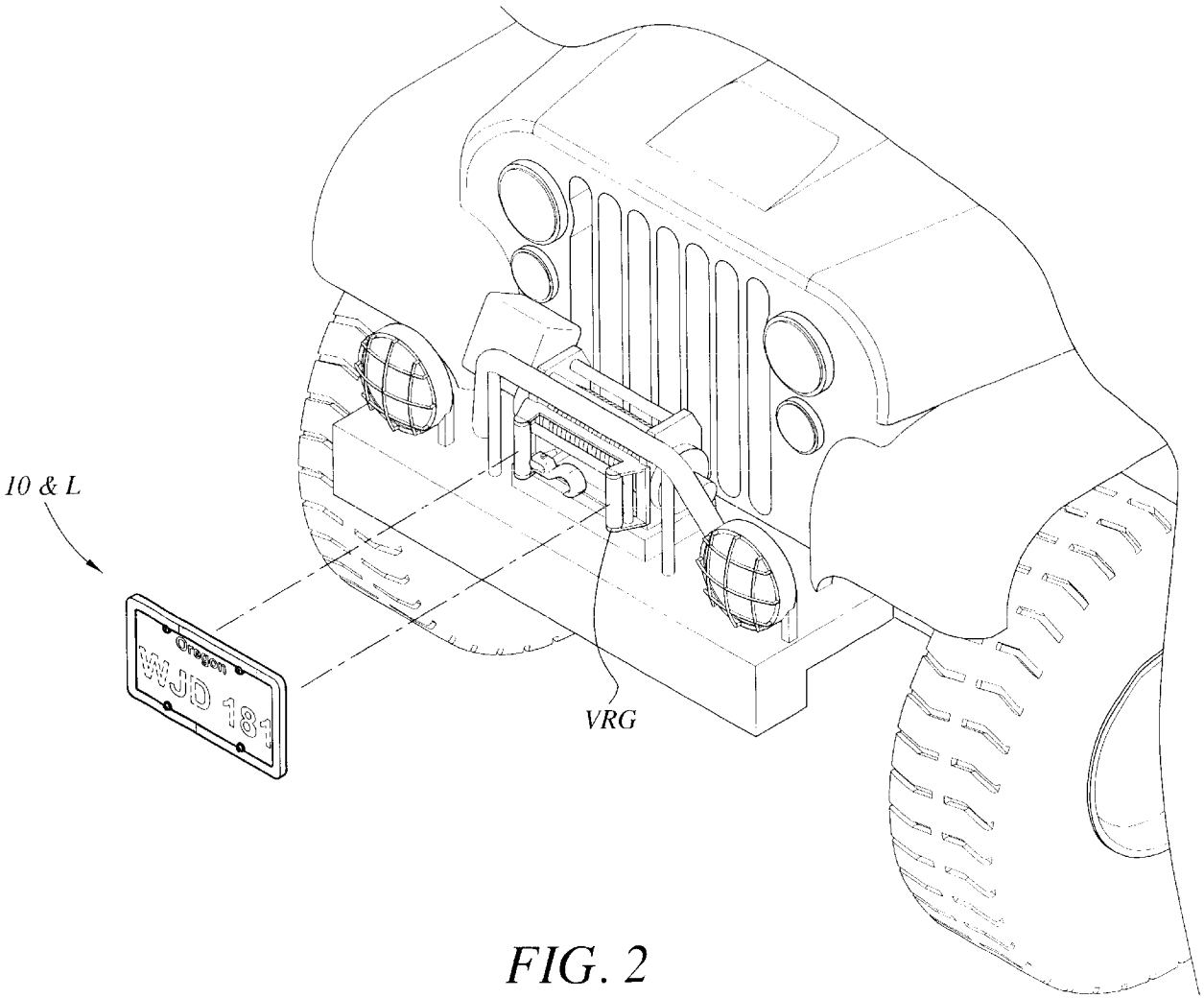
FIG. 2 is an exploded view of a license plate mounting bracket according to the present invention shown in relation to a winch on the front end of a sport utility vehicle.
Figure 3:
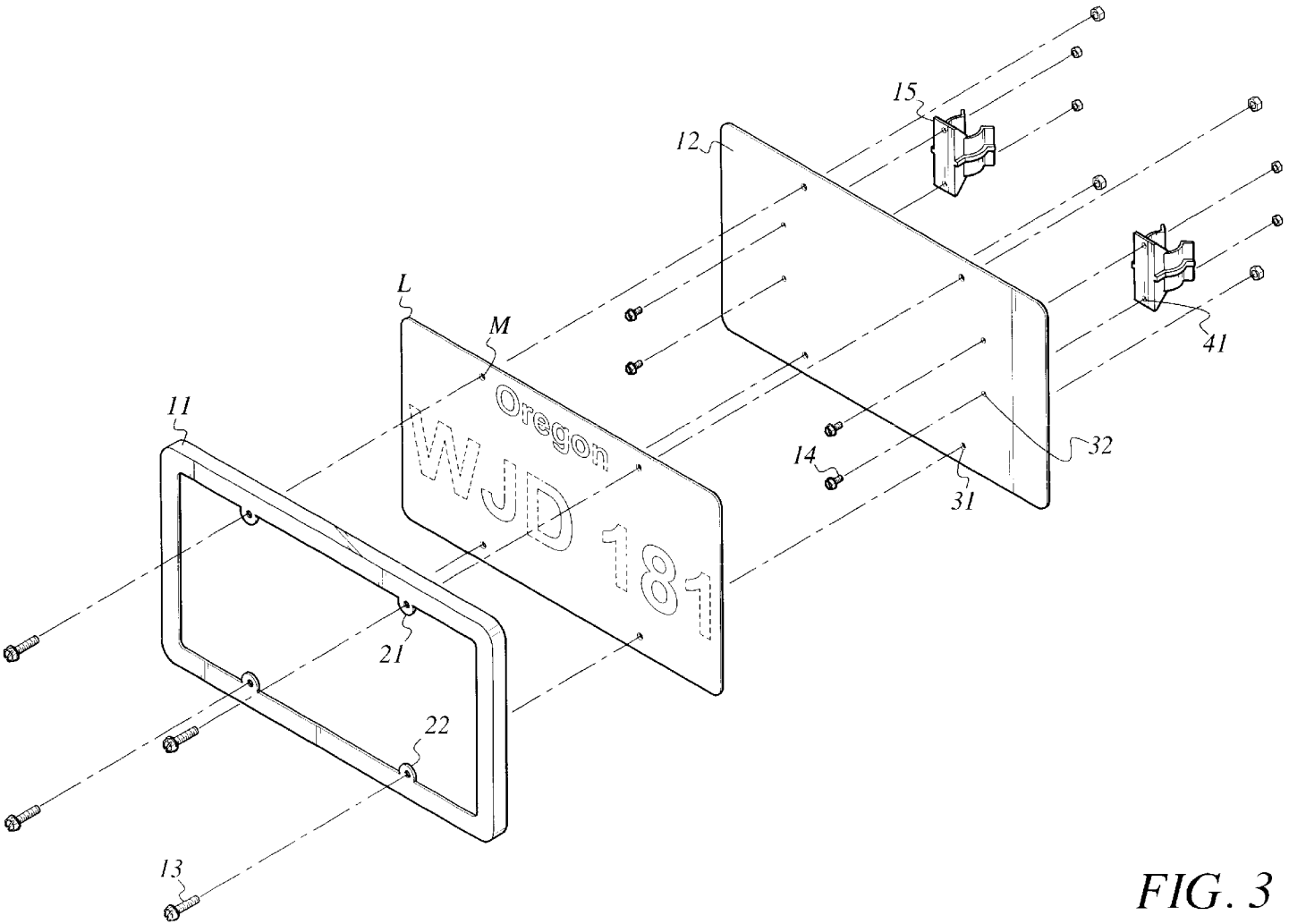
FIG. 3 is an exploded view of a license plate mounting bracket according to the present invention.
Figure 4:
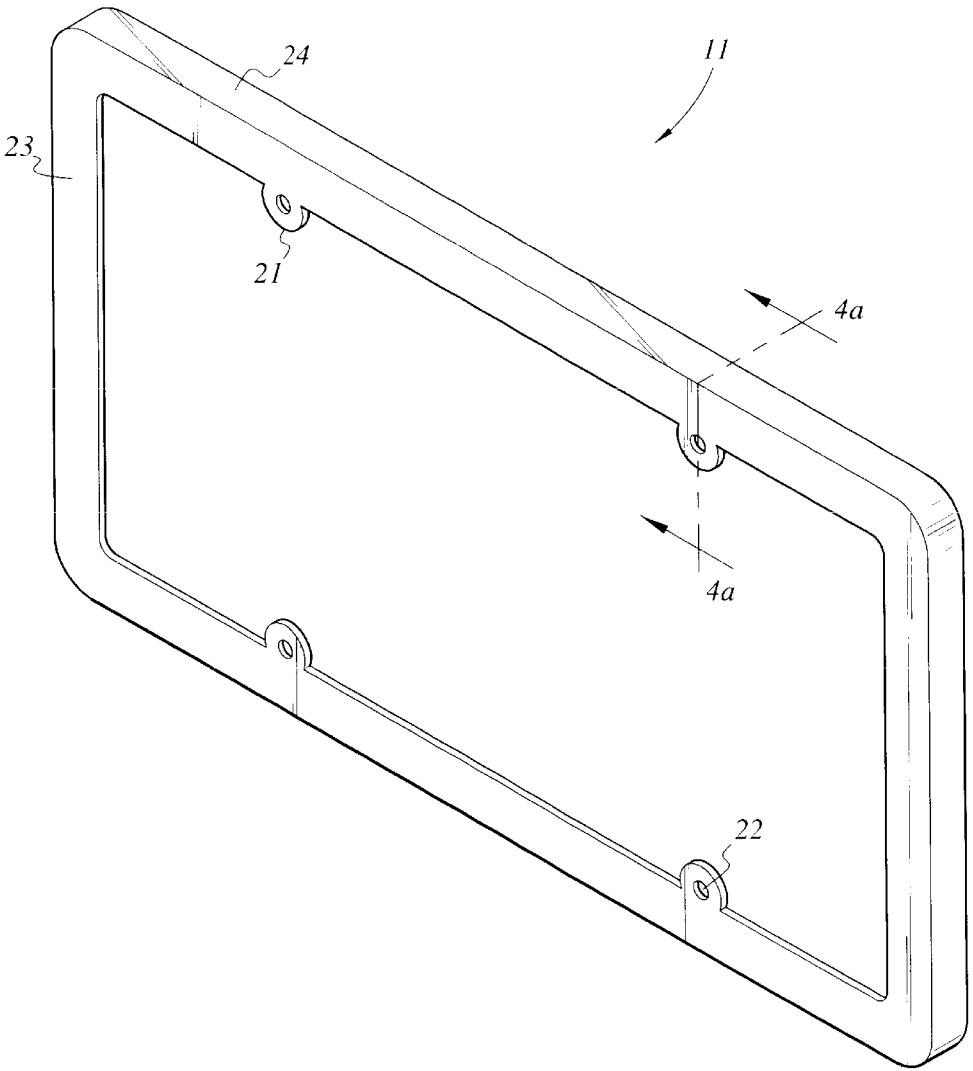
FIG. 4 is a perspective view of the frame for a license plate mounting bracket according to the present invention.
Figure 4A:
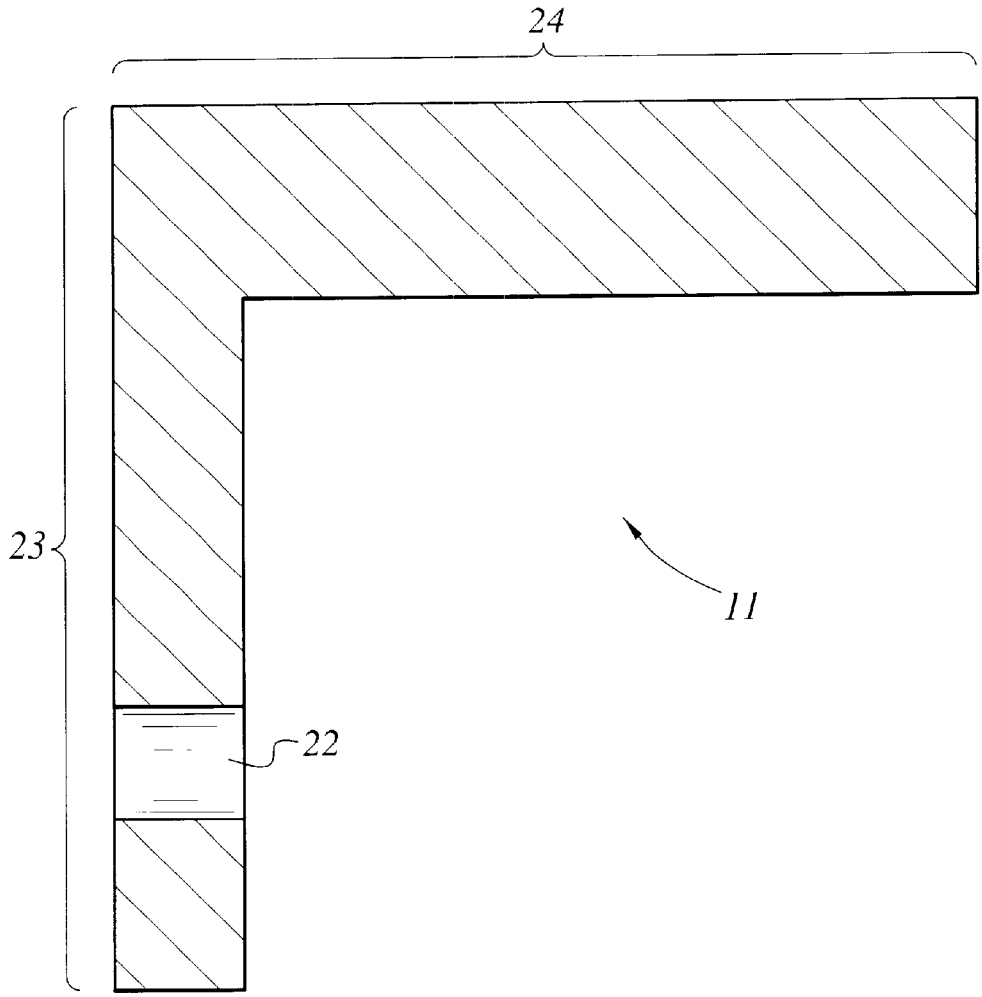
FIG. 4*a* is a cross-sectional view of a frame for a license plate mounting bracket according to the present invention shown across line 4*a*—4*a* of FIG. 4.

The device 10 consists of a frame 11, a back plate 12, eight nut and bolt assemblies 13 and 14, and two clips 15. The frame 11, shown in FIG. 4, is shaped and dimensioned for receiving a standard license plate L and has four semi-circular flanges 21 that extend from its 11 inner periphery. Each semi-circular flange 21 has an aperture 22 in which the threaded end of a bolt may be inserted. In cross-section, as shown in FIG. 4*a*, the frame 11 is L-shaped with both a vertical segmented 23 and a horizontal lip 24 extending backward from the outer periphery of the vertical segment 23. When a license plate L is positioned within the frame 11, the horizontal lip 24 fits around the outer edges of the license plate L and the apertures 22 in the semi-circular flanges 21 align with the mounting holes M in the license plate L.

The back plate 12 is flat, rectangular and substantially the same size as a standard license plate. It 12 has eight apertures 31 and 32, four 32 of which are used to secure two clips 15 to its 12 back side and four 31 of which align with the mounting holes M in a license plate L when the back plate 12 is positioned behind the license plate L within the frame 11.

Four of the eight nut and bolt assemblies 13 are used to bolt the frame 11, a license plate L and the back plate 12 together. The threaded end of each bolt is passed through an aperture 22 in a semi-circular flange 21, through a mounting hole M in a license plate L and through an aperture 31 in the back plate 12. A nut is then secured to the bolt.

Figure 5:
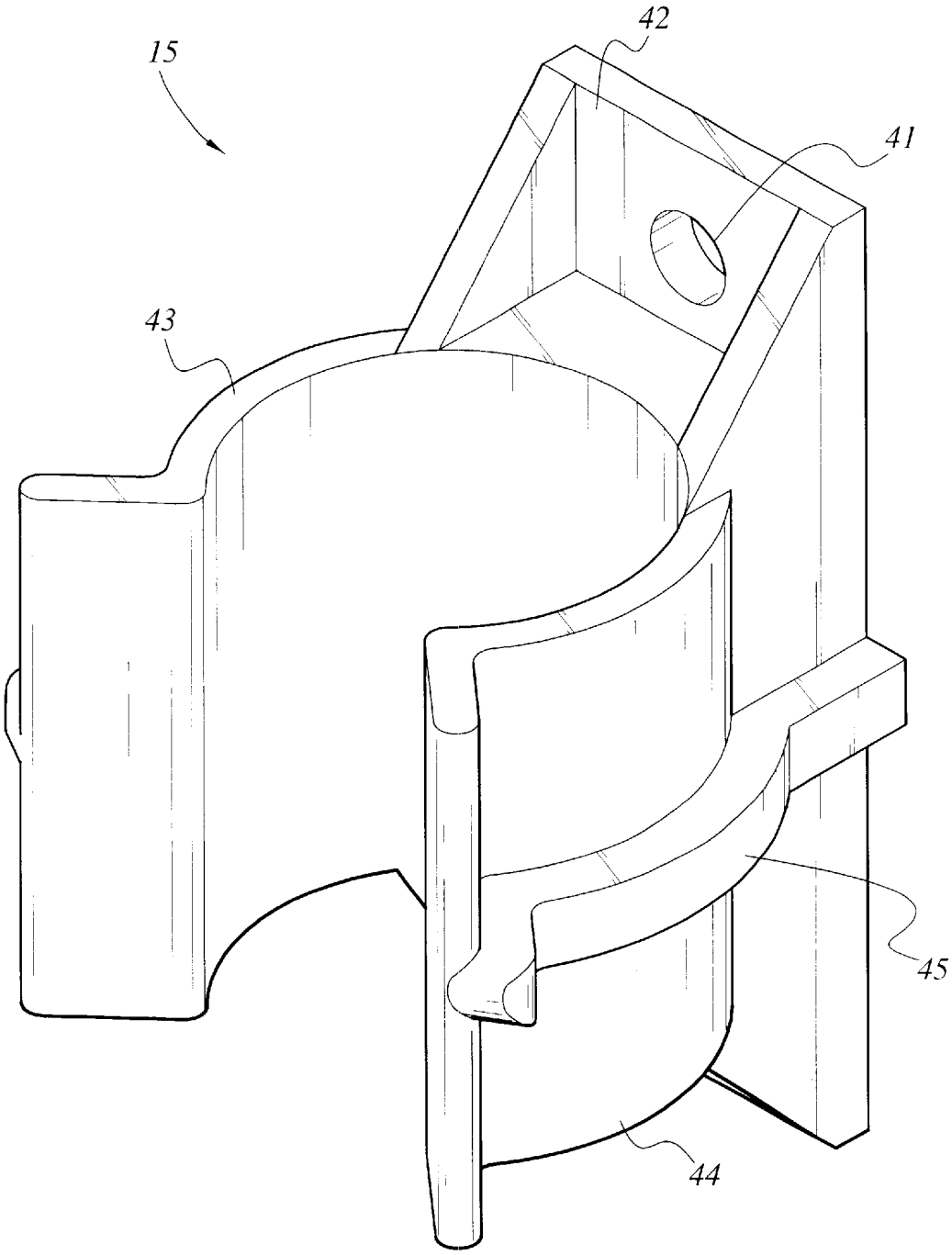
FIG. 5 is a perspective view of one clip for a license plate mounting bracket according to the present invention.

Each of the two clips 15 extends from the backside of the back plate 12 and are shaped and dimensioned to clip to one of the vertical roller guides VRG on a winch. As shown in FIGS. 5–7, each clip 15 consists of a back panel 42 and two curved members 43 and 44 that extend backward from the back panel 42. The back panel 42 has two apertures 41. The two curved members 43 and 44 form a cylindrical opening in which a vertical roller guide VRG fits snuggly. The distal end of each curved member 43 and 44 is bent outward from the cylindrical opening to form a lip for facilitating insertion of a vertical roller guide VRG into the clip 15. A ridge 45 is formed on the exterior aspect of each curved member 43 and 44 for added strength and durability. The clips 15 are secured to the back plate 12 with the remaining four nut and bolt assemblies 14 by aligning each aperture 41 in the back panels 42 of the clips 15 with a corresponding aperture 32 in the back plate 12, inserting the threaded end of a bolt through each set of aligned apertures and securing a nut to each bolt.

Once a license plate L has been bolted between the frame 11 and back plate 12, the device 10 can be mounted onto a winch by snapping the clips 17 onto the vertical roller guides VRG of the winch. When mounted, the device 10 covers the hook and cable components of the winch, thereby protecting those components from debris and providing a clean appearance to the winch and the vehicle. Additionally, the device can be easily removed from or remounted to the winch, without the aid of tools, by simply pulling the device from the winch and thereby unsnapping the clips or by simply snapping the clips back on to the vertical roller guides VRG.

An alternative embodiment of the invention includes battery-powered lights 112 attached to the frame 111. As shown in FIG. 8, lights 112 are attached to the outer surface of the frame 111 and a battery compartment 113 is integrated into the rim of the frame 111. The battery compartment accommodates a standard size battery B and wiring 114 runs from the battery compartment 113 to the lights 112. The lights 112 can be used either as a decorative means for calling attention to the vehicle or as a means of illuminating the text on the license plate.

In another embodiment 200 of the invention, as shown in FIG. 9, the two clips 215 and the back plate 212 are integrated into a single component 200 formed from a single piece of material. This embodiment avoids the expenses associated with four apertures in the back plate, two apertures in each of the clips, and four nut and bolt assemblies all of which are required when the clips are bolted to the back plate.

Another embodiment 300 of the invention integrates the frame, back plate and the clips into a single component. In this embodiment, as shown in FIGS. 10 and 11, the frame consists of a rim 311 extending from the periphery of the front side of the back plate 312 which thereby forms a recessed area shaped and sized for receiving a license plate L. The embodiment includes four nut and bolt assemblies 313 for bolting a license plate L to the framed back plate 312 and two clips 315 extending from the back side of the back plate 312 for mounting the device 300 to a winch.

It is to be understood that the present invention is not limited to the embodiments described above, but encompasses any and all embodiments within the scope of the following claims.

I claim:

1. A license plate mounting bracket for a vehicle with a winch, comprising:

a back plate being substantially flat and having a front side, a back side, two clips extending from said back side, and at least two apertures;

a rectangular frame shaped and dimensioned for receiving a license plate;

at least two flanges extending from the inner periphery of said rectangular frame;

each of said at least two flanges having an aperture for receiving the threaded portion of a bolt; and at least two nut and bolt assemblies;

wherein, when a license plate and said back plate are inserted into said rectangular frame with the license plate in front of said back plate, said apertures in said back plate and said apertures in said flanges align with mounting holes in the license plate; and wherein each of said two clips extending from said back side of said back plate is shaped and dimensioned to clip to a vertical roller guide on a winch;

whereby a license plate is secured to the vertical rollers of a winch by inserting the license plate into said rectangular frame, inserting said back plate into said rectangular frame such that said back plate is positioned behind the license plate, bolting the license plate, said back plate and said rectangular frame together with said nut and bolt assemblies, and clipping said clips to vertical rollers on a winch.

2. The device according to claim 1, wherein:

said back plate and said two clips extending from back side of said back plate are formed from one contiguous piece of material.

3. The device according to claim 2, wherein:

said contiguous piece of material is constructed of plastic.

4. The device according to claim 1, further comprising:

four nut and bolt assemblies;

wherein each of said two clips extending from said back side of said back plate has two apertures;

wherein said back plate has at least six apertures; and wherein when each aperture in each of said two clips extending from said back side of said back plate is aligned with an aperture in said back plate, said two clips are bolted to said back plate by inserting the threaded portion of a bolt through each set of aligned apertures and attaching a nut to said threaded portion of a bolt.

5. The device according to claim 1, further comprising:

at least one light attached to said rectangular frame;

a battery compartment formed in said rectangular frame; and wiring from said at least one light to said battery compartment;

wherein when a battery is placed in said battery compartment, said at least one light is illuminated.

6. A license plate mounting bracket for a vehicle with a winch, comprising:

a rectangular back plate having a front side, a back side, two clips extending from said back side, a retaining rim extending from periphery of said front side, and at least two apertures; and at least two nut and bolt assemblies;

wherein said retaining rim in said rectangular back plate forms a recessed area for receiving a license plate wherein, when a license plate is inserted into said recessed area of said rectangular back plate, said apertures in said rectangular back plate align with mounting holes in the license plate; and wherein each of said two clips extending from said back side of said back plate is shaped and dimensioned to clip to a vertical roller guide on a winch;

whereby a license plate is secured to the vertical roller guides of a winch by inserting the license plate into said recessed area of said rectangular back plate, bolting the license plate to said rectangular back plate with said nut and bolt assemblies, and clipping said clips to vertical roller guides on a winch.

7. The device according to claim 6, wherein:

said rectangular back plate and said two clips extending from back side of said rectangular back plate are formed from one contiguous piece of material.

8. The device according to claim 7, wherein: said contiguous piece of material is constructed of plastic.

* * * * *